US007950754B2

(12) United States Patent
Brown et al.

(10) Patent No.: US 7,950,754 B2
(45) Date of Patent: May 31, 2011

(54) MAGNETIC FREEZER BASKET PULL

(75) Inventors: Andrew D. Brown, Anderson, SC (US); Michael Bayne, Easley, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 59 days.

(21) Appl. No.: 12/019,957

(22) Filed: Jan. 25, 2008

(65) Prior Publication Data

US 2009/0189500 A1 Jul. 30, 2009

(51) Int. Cl.
*A47B 88/04* (2006.01)

(52) U.S. Cl. ..... 312/402; 312/404; 312/330.1; 62/382

(58) Field of Classification Search ..... 312/401, 312/402, 404, 405, 405.1, 330.1, 334.1, 334.7, 312/334.8; 62/377, 382, 440
See application file for complete search history.

(56) References Cited

U.S. PATENT DOCUMENTS

| | | | | |
|---|---|---|---|---|
| 2,843,441 | A | 7/1958 | Jewell | |
| 2,893,805 | A * | 7/1959 | Ferguson | 312/402 |
| 2,955,441 | A | 10/1960 | Dahlgren et al. | |
| 3,195,970 | A | 7/1965 | Chuboff | |
| 5,209,572 | A | 5/1993 | Jordan | |
| 5,980,009 | A | 11/1999 | Atalla et al. | |
| 6,447,083 | B1 | 9/2002 | Chiapetta et al. | |
| 6,497,113 | B1 | 12/2002 | Yamada et al. | |
| 6,915,657 | B1 | 7/2005 | Wood | |
| 6,971,730 | B2 | 12/2005 | Koons | |
| 7,082,783 | B2 | 8/2006 | Uihlein et al. | |
| 2005/0127804 | A1 | 6/2005 | Kim et al. | |
| 2005/0160854 | A1 | 7/2005 | Rotter | |
| 2006/0049731 | A1 | 3/2006 | Choi et al. | |
| 2007/0018548 | A1 | 1/2007 | Ertz et al. | |

FOREIGN PATENT DOCUMENTS

| | | | |
|---|---|---|---|
| EP | 0718572 | A | 6/1996 |
| GB | 1213388 | A | 11/1970 |
| GB | 2417671 | A | 5/1993 |
| JP | 04-045382 | | 2/1992 |
| JP | 05-113289 | | 5/1993 |
| JP | 2006141797 | A | 6/2006 |
| WO | 2007006061 | A | 1/2007 |

OTHER PUBLICATIONS

International Search Report for PCT/US2009/030733, dated May 8, 2009, 3 pages.

* cited by examiner

*Primary Examiner* — James O Hansen
(74) *Attorney, Agent, or Firm* — Pearne & Gordon LLP

(57) ABSTRACT

A pull-out drawer assembly for a refrigerator bottom freezer. The assembly includes upper and lower baskets slidably mounted one above the other. The bottom basket has a drawer face mounted to its front edge. The upper basket has a magnet which cooperates with an engagement device that is mounted on the lower basket and is attractable to the magnet so that, when the drawer is pulled out of the freezer compartment, both drawers travel as a unit. The upper drawer can then be pushed back to disengage the engagement device from the magnet and provide access to the lower basket.

18 Claims, 3 Drawing Sheets

MAGNETIC FREEZER BASKET PULL

FIELD OF THE INVENTION

This invention relates to a pull-out drawer assembly for a refrigerator compartment and, more particularly to a basket arrangement in a pull-out bottom freezer.

BACKGROUND OF THE INVENTION

Bottom freezer pull-out drawers usually have two baskets with one basket mounted above the other. The bottom basket is attached to the drawer face so that the bottom basket is pulled out by the drawer face while the upper basket remains in the freezer compartment. It is more desirable to have both baskets pulled out when opening the drawer and, to that end, prior art arrangements provided a manual latch between the upper and lower baskets so that the upper basket would be pulled out of the compartment by the lower basket. Such latches are cumbersome however.

It is desirable, therefore, to provide an arrangement wherein both baskets would be pulled out of the compartment when the drawer is open and wherein the upper basket may be returned to the compartment for access to the lower basket without manually unlatching the baskets.

SUMMARY OF THE INVENTION

The present invention provides a drawer assembly for a cooled compartment comprising first and second containers movably mounted one above another, said second basket being connected to a drawer face and being movably mounted so that said second basket and said drawer face can be moved as a unit, said first basket being movably mounted so that said first basket can be moved relative to said second basket, a magnet mounted on at least one of said second basket, said drawer face or said first basket, and an engagement device attractable by said magnet mounted on at least another of said second basket, said drawer face or said first basket and facing said magnet so that, when said magnet and said engagement device are engaged, the drawer and the first and second baskets may be moved as a unit and the first basket may moved to separate the magnet from the engagement device and gain access to said second basket.

According to further aspects of the invention at least one of said containers can be a basket. At least one of said containers can be slidably mounted on side rails. Said engagement device can be a metal part of a container support structure. Said containers are movably withdrawn from the compartment and said first container can be pushed back toward the compartment to disengage the magnet from engagement device. The compartment can be refrigerated. Said refrigerator compartment can be a bottom freezer.

According to other aspects of the invention, said first container can be located above said second container and disengagement of the engagement device from the magnet occurs by manually applying a force to the upper container while applying an opposite force to the lower container, which then permits the upper container to be moved separately from the lower container and provide access to the lower container. In another aspect, disengagement of the engagement device from the magnet occurs by limiting travel of the upper container relative to the lower container. Said magnet can be mounted on said first container and said engagement device can be mounted on said second container. Outward travel of said second container can be greater than the outward travel of said first container, so that said magnet and said engagement device will be separated when the first container reaches the extent of its travel.

According to still further aspects of the invention, at least one of said containers can be slidably mounted on side rails and said side rails comprise an outer slide member fixed to a side of said compartment, an intermediate slide member slidable in the outer member and an inner slide member slidable in the intermediate member and fixed to a side of one of said containers.

In yet another aspect of the invention a drawer assembly for a refrigerator compartment includes a multiple basket arrangement comprising first and second baskets slidably mounted one above another, said second basket being connected to a drawer face and being slidably mounted on first side rails so that said second basket and said drawer face can be opened as a unit, said first basket being slidably mounted on second side rails so that the said first basket can be moved relative to said second basket, each of said side rails comprising an outer slide member fixed to a side of said compartment, and intermediate slide member slidable in the outer member and an inner slide member slidable in the intermediate member and fixed to the side of a basket, a magnet mounted on said first basket, and an engagement device attractable by said magnet mounted on said second basket. Outward travel of said second basket can be greater than the outward travel of said first basket, so that said magnet and said engagement device will be separated when the first basket reaches the extent of its travel.

When the baskets are in the compartment, the magnet can be engaged with the attractable device so that, when the drawer is pulled out, both baskets travel as a unit. The top basket may be manually pushed back into the compartment to gain access to the lower basket. The drawer assembly may be designed so that the total outward travel of the upper basket is slightly less than the total outward travel of the lower basket. This causes separation of the magnet and the engagement device.

DETAILED DESCRIPTION OF THE INVENTION

Figure 1:
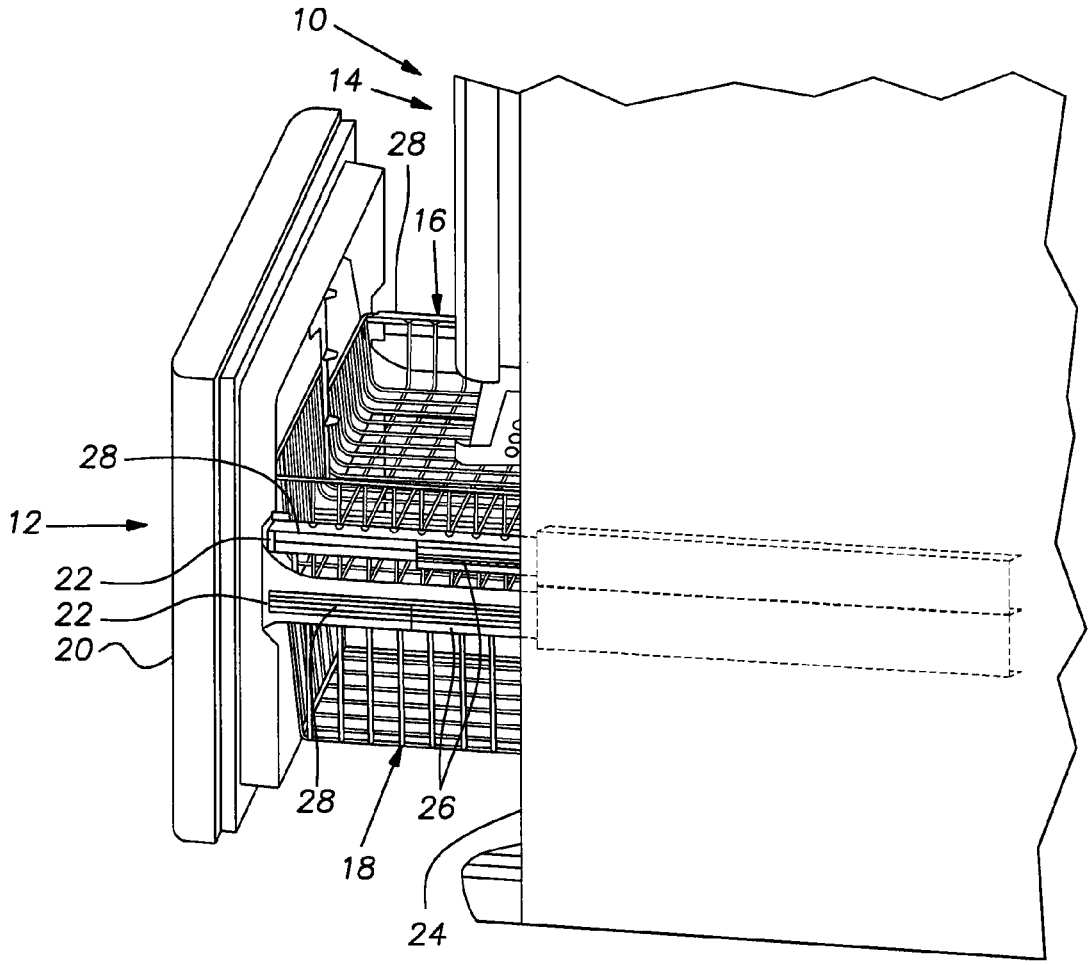
FIG. 1 is a fragmentary perspective view of a refrigerator having a bottom drawer freezer, showing the drawer partially pulled out.

Referring now to the drawings, a freezer-refrigerator 10 having a pull-out drawer 12 of a freezing compartment 14 is illustrated. The freezing compartment is cooled, for example, by a refrigeration circuit. The invention is also suitable for application to other cooled compartments such as a fresh food compartment. As illustrated, the freezing compartment is located below a refrigerated fresh food compartment in what is commonly known as a "bottom-mount" configuration, but other configurations, such as "side-by-side" are also suitable. The freezing compartment 14 has a multiple container arrangement which comprises a top basket 16 and a lower basket 18. Other suitable containers include, for example, bins, trays, or tubs. In addition the containers need not match, for example, one could be a bin and the other could be a basket. The lower basket 18 is connected to a drawer face 20 in any form suitable for providing an ability to move the lower basket.

The baskets 16 and 18 are movably mounted on side rails 22. As illustrated, the baskets are slidable. Other movable configurations are also suitable, for example, the baskets could be mounted on rollers or have rollers attached thereto or the baskets could be mounted to scissor arm supports. In addition, the baskets may be mounted and movable differently from each other, for example, the lower basket could be slidable on rails and the upper basket could have rollers riding on the lower basket or some portion of the lower basket support structure.

When using side rails, as illustrated, the side rails could comprise a typical three part drawer slide. Such a slide is disclosed in U.S. Pat. No. 5,209,572, the disclosure of which is incorporated herein by reference. The three part drawer slide includes an outer slide member 24 fixed to the side of the freezer compartment, an intermediate slide member 26, slidable in the outer member 24 and inner slide member 28 slidable in the intermediate slide member 26. An inner slide member 28 is fixed to the sides of the upper and lower baskets 16 and 18 so that the baskets may slide relative to each other. Ball bearings (not shown) enable the inner slide members 28 to telescope smoothly in and out of the intermediate members and allow the intermediate members 26 to telescope smoothly in and out of the outer members 24.

Figure 2:
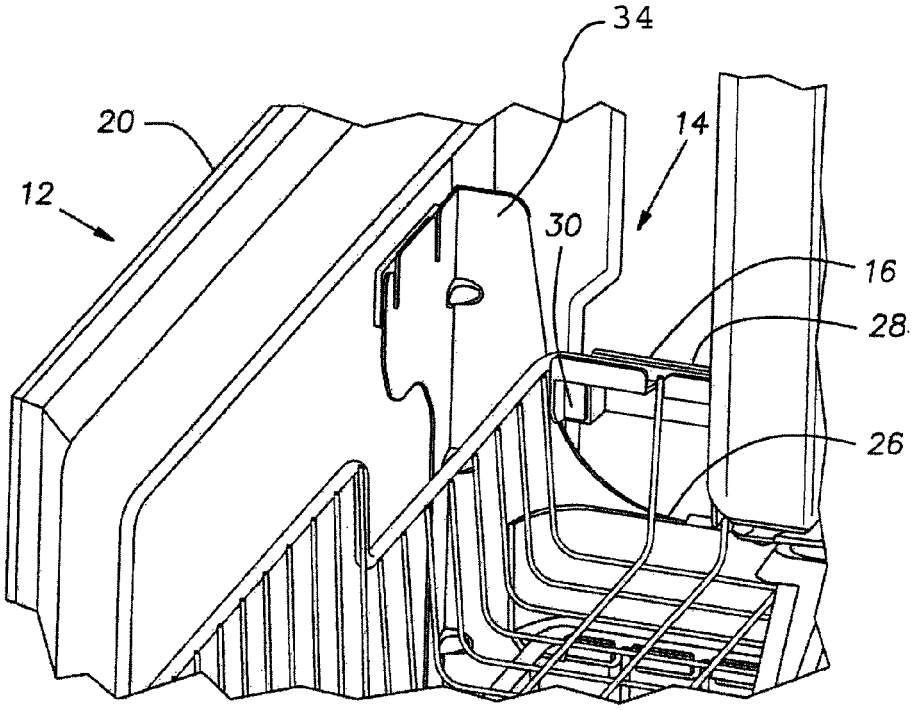
FIG. 2 is an enlarged fragmentary perspective view of a refrigerator, similar to FIG. 1, showing details of the magnetic connection that permits separation between the upper and lower baskets of the drawer.
Figure 3:
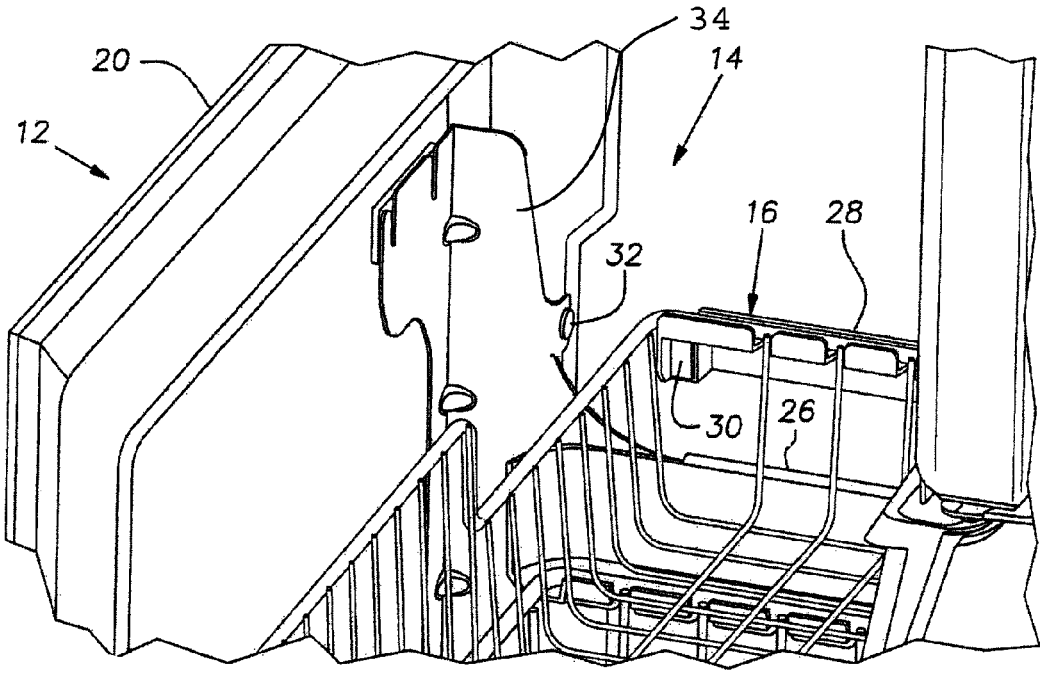
FIG. 3 is an enlarged fragmentary perspective view of a refrigerator, similar to FIG. 2, but showing the magnet separated from its engagement device.

Referring to FIGS. 2 and 3, magnets 30 are fixed adjacent the ends of the inner slide members 28 of the upper basket 16. It will be appreciated that one or both of the inner slide members of the upper basket may carry a magnet 30. An engagement device 32 attractable by the magnet 30 (see FIG. 3) is carried by a flared portion of a mounting bracket 34 securing the drawer face 20 to the inner slide member 28 carrying the lower basket 18. The engagement device may be any material, such as iron, nickel or cobalt and various alloys, that is attracted to the magnet with sufficient force to operate as described herein and preferably exhibits high magnetic permeability.

The engagement device can be a separate component mounted to the bracket or could be an integral part of the bracket, such as a metal flange of the bracket. It should be appreciated that the positions of the magnet 30 and the engagement device 32 may be reversed so that the magnet is mounted on the bracket and the engagement device is mounted on the slide member carrying the upper basket, for example. Alternatively, the engagement device and magnet can be mounted to different corresponding parts of the drawer system structure, such as the drawer face, basket, slide rail or other basket support structure. Again, wherever the engagement device is located, the engagement device can be a separate, mounted component or an integral part.

Figure 4:
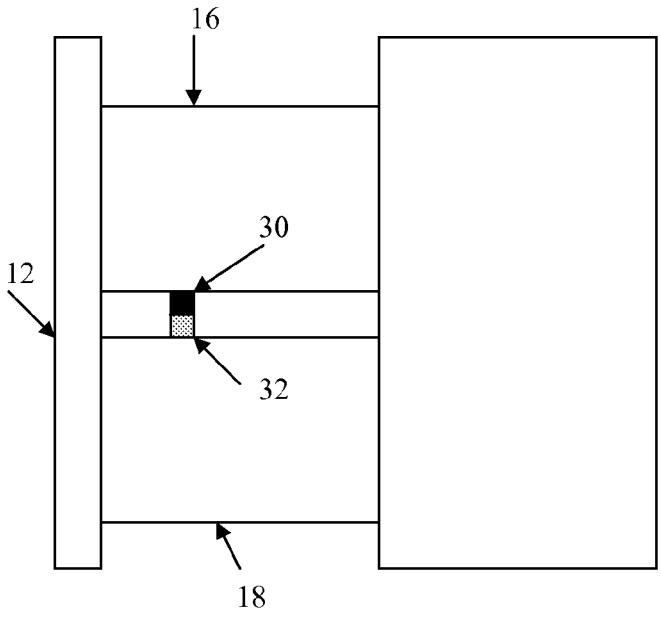
FIG. 4 is a schematic depiction of a side view of a drawer assembly with a magnet mounted on one of a first upper container and second lower container and an engagement device mounted on the other of the first upper container and the second lower container with the magnet engaging the engagement device.
Figure 5:
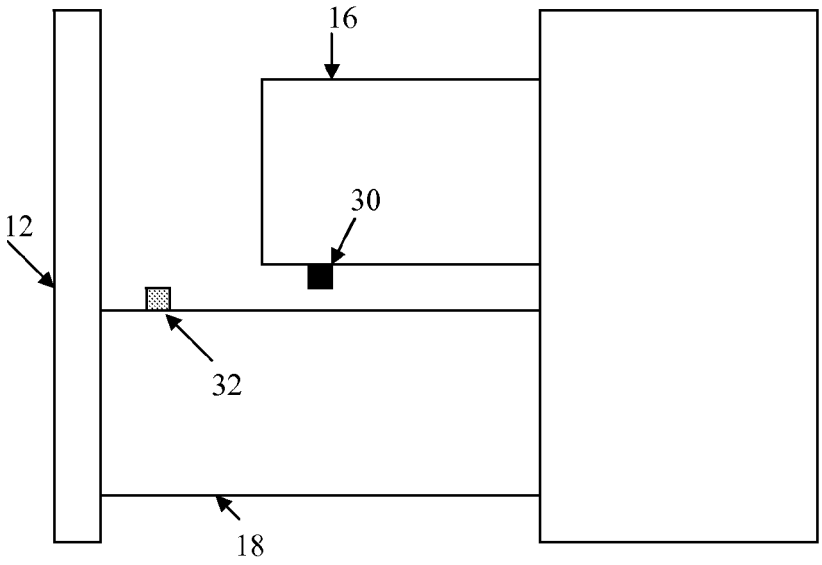
FIG. 5 is a schematic depiction of the side view of the drawer assembly of FIG. 4 wherein the engagement device is disengaged from the magnet and the first upper container is separated from the second lower container.

The magnet can be mounted on one of the first container 16 and the second container 18 of the drawer 12 and the engagement device can be mounted to the other of the first container 16 and the second container 18 of the drawer 12. As illustrated in FIGS. 4 and 5, the magnet 30 is shown to be mounted to the first container 16 and the engagement device is shown as mounted to the second container 18, although the respective mounting positions of the magnet and the engagement device can be reversed between the first and second containers.

When the drawer face 20 is closed and both baskets 16 and 18 are in the freezer compartment, the magnet 30 and the engagement device 32 are engaged. When the drawer face 20 is pulled outwardly to open the freezing compartment 14, both the top and bottom baskets are pulled out of the compartment 14 as a unit, because of the attraction between the magnet 30 and the device 32. This brings the top basket 16 at hand and since frequently used items are placed in this basket, they are readily accessible. If one desires to access the bottom basket 18, the top basket 16 is pushed into the freezer compartment 14.

The baskets 16 and 18 may be separated automatically after being pulled from the compartment 14. This is accomplished by designing the upper side rail 22 so that it does not extend as far as the lower side rail 22. In such an arrangement, the lower side rail 22 may travel a distance(for example, about 2 cm) farther than the upper side rail and the magnet 30 will automatically separate from the device 32.

When engaged, the magnet and engagement device allow movement of the two baskets as a unit with movement of the drawer face. Disengagement of the engagement device from the magnet occurs by manually applying a force to the upper basket (while applying an opposite force, for example, inertial, frictional, or manual, to the lower basket) or by limiting travel of the upper basket relative to the lower basket, which then permits the upper basket to be moved separately from the lower basket and provide access to the lower basket.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed:

1. A drawer assembly for a cooled compartment comprising first and second containers movably mounted one above another, said second container being connected to a drawer face and being movably mounted so that said second container and said drawer face can be moved as a unit, said first container being movably mounted so that said first container can be moved relative to said second container, a magnet mounted on at least one of said second container, said drawer face or said first container, and an engagement device attractable by said magnet mounted on at least another of said second container, said drawer face or said first container and facing said magnet so that, when said magnet and said engagement device are engaged, the drawer face and the first and second containers may be moved as a unit and the first container may be moved to separate the magnet from the engagement device and gain access to said second container, wherein at least one of the magnet or the engagement device is mounted on an inner slide member carrying the first container or the second container where the inner slide member is configured to allow the first container or the second container to slide, wherein the outward travel of said second container is greater than the outward travel of said first container, so that said magnet and said engagement device will be separated when the first container reaches the extent of its travel.

2. A drawer assembly as claimed in claim 1, wherein at least one of said containers is a basket.

3. A drawer assembly as claimed in claim 1, wherein at least one of said containers is slidably mounted.

4. A drawer assembly as claimed in claim 1, wherein at least one of said containers is slidably mounted on side rails.

5. A drawer assembly as claimed in claim 1, wherein said engagement device is a metal part of a container support structure.

6. A drawer assembly as claimed in claim 1, wherein said containers are movably withdrawn from the compartment and said first container is pushed back toward the compartment to disengage the magnet from engagement device.

7. A drawer assembly as claimed in claim 1, wherein the compartment is refrigerated.

8. A drawer assembly as claimed in claim 1, wherein said first container is located above said second container and disengagement of the engagement device from the magnet occurs by limiting travel of the upper container relative to the lower container, which then permits the upper container to be moved separately from the lower container and provide access to the lower container.

9. A drawer assembly as claimed in claim 1, wherein said magnet is mounted on one of said first container and second container and said engagement device is mounted on the other of said first container and second container.

10. A drawer assembly according to claim 1, wherein at least one of said containers is slidably mounted on side rails and said side rails comprise an outer slide member fixed to a side of said compartment, an intermediate slide member slidable in the outer member and the inner slide member which is slidable in the intermediate member and fixed to a side of one of said containers.

11. A drawer assembly according to claim 1, wherein said cooled compartment is a bottom freezer.

12. A drawer assembly for a refrigerator compartment including a multiple container arrangement comprising first and second containers slidably mounted one above another, said second container being connected to a drawer face and being slidably mounted on first side rails so that said second container and said drawer face can be opened as a unit, said first container being slidably mounted on second side rails so that the said first container can be moved relative to said second container, each of said side rails comprising an outer slide member fixed to a side of said compartment, an intermediate slide member slidable in the outer member and an inner slide member slidable in the intermediate member and fixed to the side of a container, a magnet mounted on one of said first container and second container, and an engagement device attractable by said magnet mounted on the other of said first container and second container so that, when said magnet and said engagement device are engaged, the drawer face and the first and second containers may be moved as a unit, wherein the outward travel of said second container is greater than the outward travel of said first container, so that said magnet and said engagement device will be separated when the first container reaches the extent of its travel.

13. A drawer assembly as claimed in claim 12, wherein said first container is located above said second container and disengagement of the engagement device from the magnet occurs by limiting travel of the upper container relative to the lower container, which then permits the upper container to be moved separately from the lower container and provide access to the lower container.

14. A drawer assembly as claimed in claim 12 wherein one of the magnet and the engagement device is mounted on the inner slide member carrying one of the first container and the second container.

15. A drawer assembly for a cooled compartment comprising first and second containers movably mounted one above another, said second container being connected to a drawer face and being movably mounted so that said second container and said drawer face can be moved as a unit, said first container being movably mounted so that said first container can be moved relative to said second container, a magnet mounted on said first container, and an engagement device attractable by said magnet mounted on said drawer face and facing said magnet so that, when said magnet and said engagement device are engaged, the drawer face and the first and second containers may be moved as a unit and the first container may be moved to separate the magnet from the engagement device and gain access to said second container, wherein the magnet is mounted on an inner slide member of the first container, wherein the engagement device is carried by a flared portion of a mounting bracket that is attached to the drawer face.

16. A drawer assembly as claimed in claim 15, wherein said first container is located above said second container and disengagement of the engagement device from the magnet occurs by limiting travel of the upper container relative to the lower container, which then permits the upper container to be moved separately from the lower container and provide access to the lower container.

17. A drawer assembly as claimed in claim 15, wherein the outward travel of said second container is greater than the outward travel of said first container, so that said magnet and said engagement device will be separated when the first container reaches the extent of its travel.

18. A drawer assembly as claimed in claim 1, wherein said first container is located above said second container and disengagement of the engagement device from the magnet occurs by manually applying a force to the upper container while applying an opposite force to the lower container, which then permits the upper container to be moved separately from the lower container and provide access to the lower container.

* * * * *